US008881341B2

(12) United States Patent
Schmidt, Jr.

(10) Patent No.: US 8,881,341 B2
(45) Date of Patent: Nov. 11, 2014

(54) DEBRIS COLLECTING SYSTEM

(75) Inventor: Ronald L. Schmidt, Jr., Lake Bluff, IL (US)

(73) Assignee: Federal Signal, Oak Brook, IL (US)

( * ) Notice: Subject to any disclaimer, the term of this patent is extended or adjusted under 35 U.S.C. 154(b) by 377 days.

(21) Appl. No.: 13/112,663

(22) Filed: May 20, 2011

(65) Prior Publication Data

US 2012/0291813 A1 Nov. 22, 2012

(51) Int. Cl.

| | |
|---|---|
| ***A47L 9/10*** | (2006.01) |
| ***B65F 1/10*** | (2006.01) |
| ***E03F 9/00*** | (2006.01) |
| ***B65F 3/02*** | (2006.01) |

(52) U.S. Cl.

CPC . *E03F 9/00* (2013.01); *B65F 1/105* (2013.01); *B65F 3/0209* (2013.01)

USPC ..... 15/347; 15/340.1

(58) Field of Classification Search

USPC ..... 15/340.1–340.3, 315, 346, 347

See application file for complete search history.

(56) References Cited

U.S. PATENT DOCUMENTS

| | | | | |
|---|---|---|---|---|
| 3,658,589 | A | 4/1972 | Shaddock | |
| 3,665,545 | A * | 5/1972 | Beekman | 15/314 |
| 4,446,591 | A | 5/1984 | Wiedemann | |
| 4,525,277 | A | 6/1985 | Poulin | |
| 4,578,840 | A * | 4/1986 | Pausch | 15/352 |
| 4,659,262 | A * | 4/1987 | van Aalst | 406/29 |
| 4,838,907 | A * | 6/1989 | Perry | 55/381 |
| 4,935,984 | A * | 6/1990 | Bryant et al. | 15/302 |
| 5,030,259 | A | 7/1991 | Bryant et al. | |
| 5,062,868 | A | 11/1991 | Kennedy | |
| 5,840,102 | A * | 11/1998 | McCracken | 95/268 |
| 5,996,171 | A | 12/1999 | Bowers | |
| 6,790,368 | B1 * | 9/2004 | Vachon et al. | 210/747.1 |
| 6,792,646 | B1 | 9/2004 | Greene et al. | |
| 7,281,296 | B2 | 10/2007 | Strauser | |
| 7,323,022 | B1 | 1/2008 | Redlin | |

* cited by examiner

*Primary Examiner* — Dung Van Nguyen
(74) *Attorney, Agent, or Firm* — Merchant & Gould P.C.

(57) ABSTRACT

A debris collecting system comprises a debris collecting assembly including an air-flow generating device and a debris body. The system further comprises an intermediate debris collecting container connected to the debris collecting assembly such that the collected debris is by-passing the debris body of the assembly.

9 Claims, 7 Drawing Sheets

DEBRIS COLLECTING SYSTEM

TECHNICAL FIELD

The present invention relates to a cleaning/recycling system and more specifically, to a cleaning/recycling system allowing for collecting debris as well as a method for such collection.

BACKGROUND

Mobile debris collection systems are useful in a number of industrial and environmental applications. For example, trucks carrying sewer vacuum cleaners are used for picking up heavy debris, such as street sweepings, sand, grit, building bricks, stones, heavy wet leaves, bottles, cans and similar materials found in, e.g. storm drain sewers.

For high volume applications such sewer vacuum trucks will require multiple load and unload cycles. This typically requires unloading the debris body and repositioning the truck, which causes down time as well as traffic concerns. Improvements are needed.

SUMMARY

In general terms, this disclosure is directed to a debris collecting system. In one possible configuration and by non-limiting example, debris is collected using different kinds of debris collecting systems comprising at least one intermediate debris collecting container One aspect is a debris collecting system comprising an assembly, such as a truck or a trailer, including an air-flow generating device configured to apply debris conveying air to the system and a debris body configured to collect debris. The system also includes a debris collecting container placed in close proximity to the assembly, such as behind or in front of the assembly. The system further includes a first conveying pipe having a debris-receiving portion and a debris body portion, the debris-receiving portion end being configured to receive debris to be removed and the debris body portion being connected to the debris body. In addition, the system includes a second conveying pipe having a first end portion connected to the debris body portion of the first conveying pipe and a second end portion connected to the debris collecting container, wherein airborne debris is caused to travel through the first and second conveying pipes and is separated from the conveying air and collected in the debris collecting container.

Another aspect is a method of collecting debris with a debris collecting system. The method comprises the steps of providing a first conveying pipe having a debris body portion connected to a debris body and providing a second conveying pipe having a first end portion connected to the debris body portion of the first conveying pipe and a second end portion connected to a debris collecting container. The method further comprises the step of generating an air-flow in the debris collecting system. Debris to be removed is received in a debris-receiving portion of the first conveying pipe, transported through the first and the second conveying pipes, and separated from the conveying air in the debris collecting container.

Thanks to the provision of a debris collecting truck in a configuration including an intermediate debris collecting container connected to the debris collecting truck such that the collected debris is by-passing the debris body of the truck, easier removal of heavy material is obtained.

DETAILED DESCRIPTION

Figure 1:
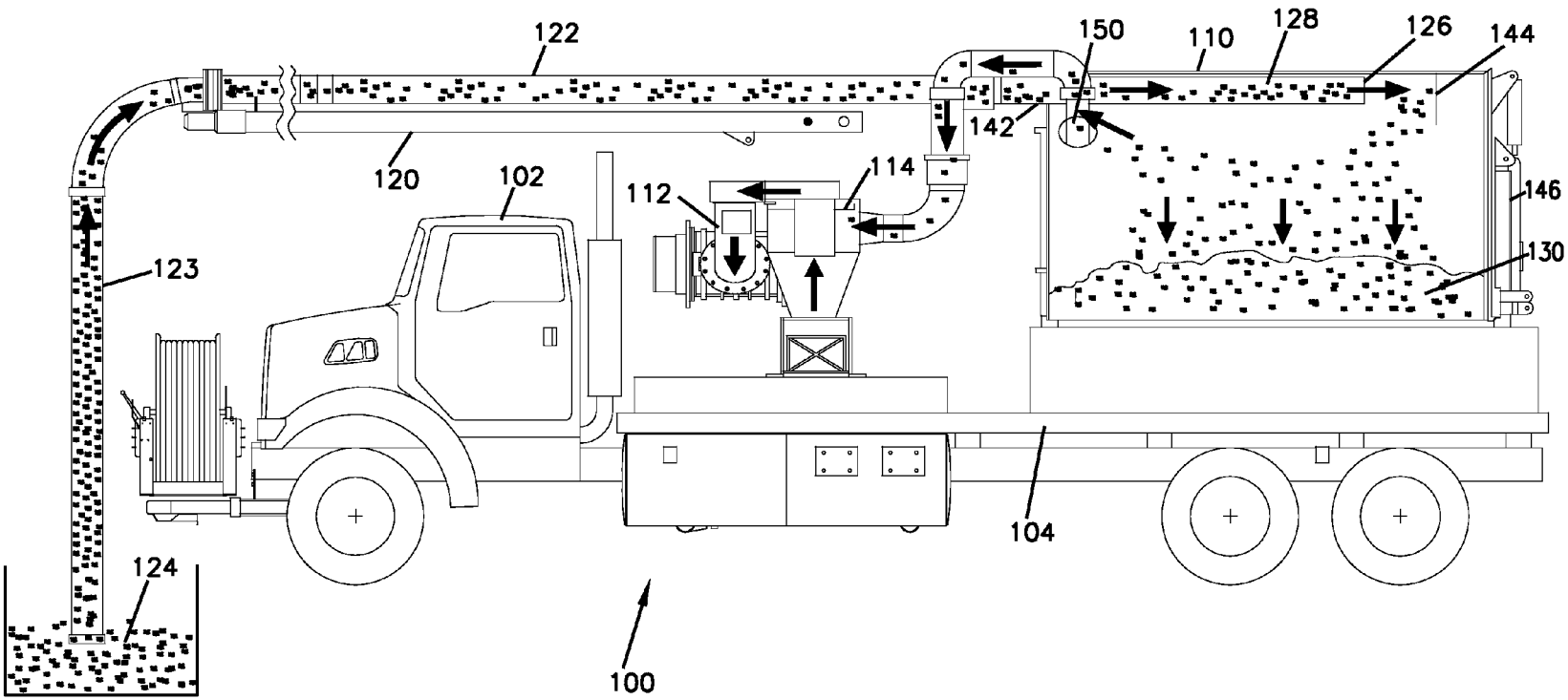
FIG. 1 (Prior Art)
FIG. 1 is a schematic side elevation illustrating a prior art debris collecting truck.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a simplified side elevation of a prior art debris collecting truck 100 comprising a cab 102 and a truck chassis 104 supporting, for example, a debris body 110, an air-flow generating device 112, such as a vacuum source, and a filtration system 114. The truck 100 further comprises a boom 120, a conveying pipe 122 supported by the boom 120, and other equipments for operating the truck 100 for sewer cleaning, storm drain cleaning, other types of catch basin cleaning, leaf collection, litter collection, hydroexcavation, industrial vacuum cleaning, and other pneumatic conveying applications.

The conveying pipe 122 comprises a debris-receiving portion 123 or section having a conveying pipe inlet 124 and a debris body portion 128 or section. The debris-receiving portion 123 and the debris body portion 128 can be at different ends of the pipe 122, or alternatively along any section along the pipe 122. Debris 130 that needs to be removed enters the conveying pipe 122 with conveying air through the conveying pipe inlet 124. The debris 130 travels through the conveying pipe 122 and exits the conveying pipe 122 at a conveying pipe outlet 126 inside the debris body 110. The debris body 110 comprises an opening 142 through which the debris body portion 128 of the conveying pipe 122 is inserted. The debris body further comprises a deflector 144. The debris body portion 128 extends inside the debris body 110 and stops before the deflector 144, such that debris 130 and conveying air that exits the conveying pipe outlet 126 hits the deflector 144 and the debris falls to the bottom of the debris body 110 and separates from the conveying air. The conveying air enters an air conveying pipe 150 and travels to the filtration system 114, in which possible remaining debris is filtrated from the air.

The debris body 110 further comprises an air and water tight door 146 allowing for discharging the debris, for cleaning the debris body 110, and for inspecting the debris body 110.

Figure 2:
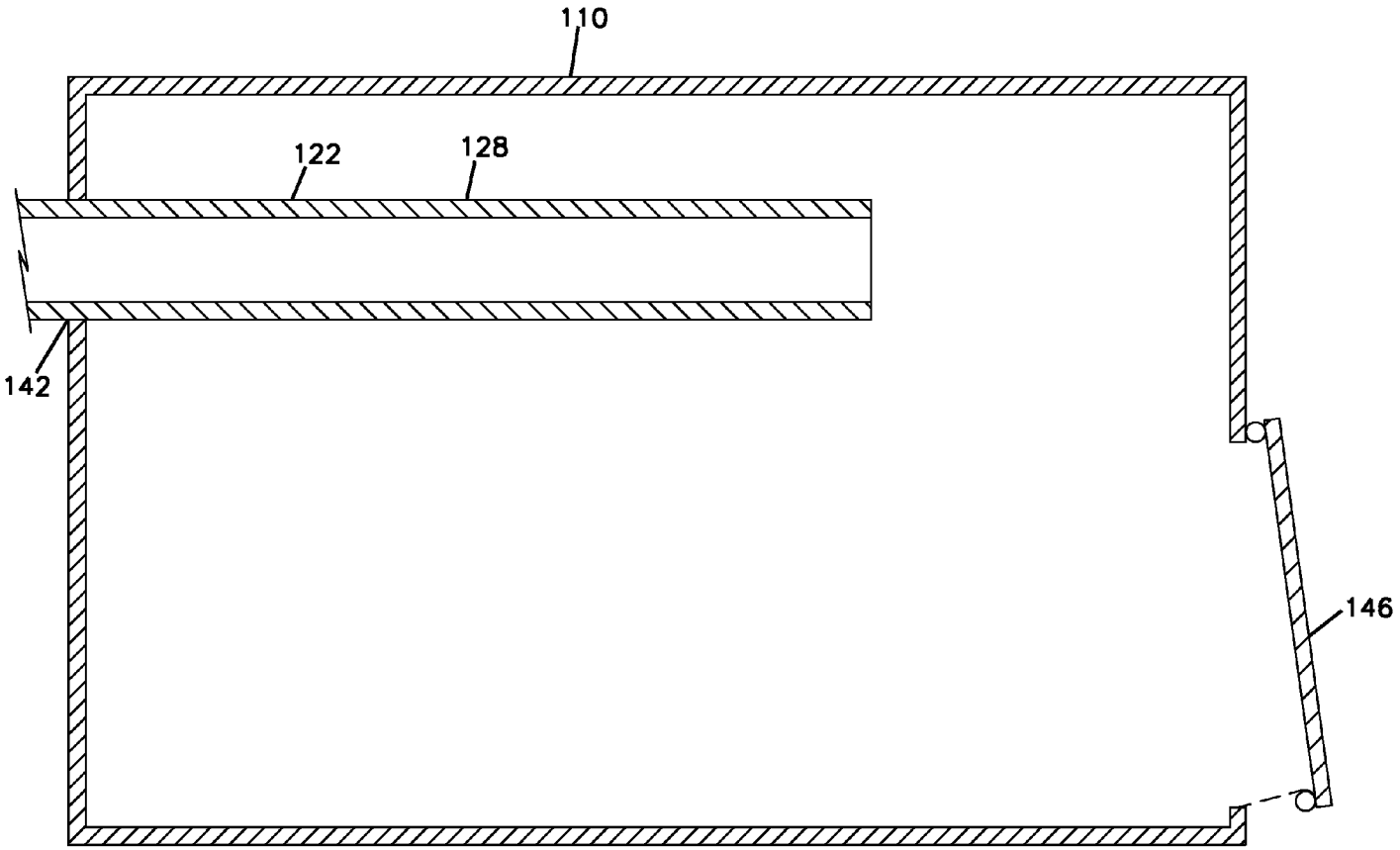
FIG. 2 (Prior Art)
FIG. 2 is a side view in cross-section of an exemplary simplified prior art debris body.

FIG. 2 is a cross-section of the prior art debris body 110 showing the opening 142 of the debris body 110 and the debris body portion 128 of the conveying pipe 122. The opening 142 receives the debris body portion 128 of the conveying pipe 122. Shown in FIG. 2 is also the rear opening sealed with the air and water tight door 146.

Figure 3:
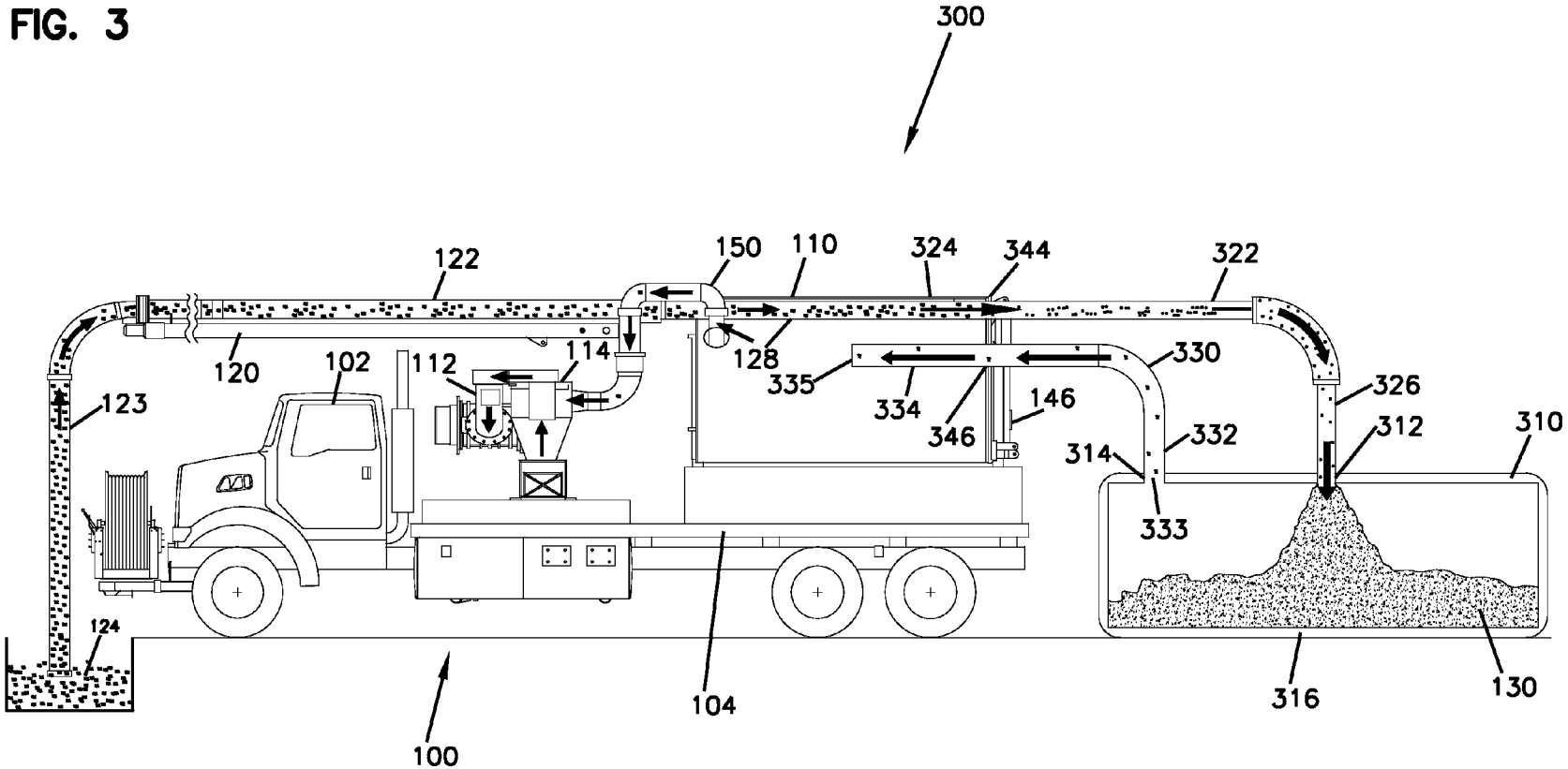
FIG. 3 is a schematic side elevation of an exemplary debris collecting system.

FIG. 3 shows an exemplary debris collecting system 300 comprising a debris collecting truck 100 and an intermediate debris collecting container 310. The debris collecting truck 100 comprises a cab 102 and a truck chassis 104 supporting, for example, a debris body 110, an air-flow generating device 112 and a filtration system 114. In some embodiments the air-flow generating device 112 is a vacuum source. In the shown embodiment, a debris collecting truck 100 is used. However, in some embodiments, the debris body 110, the air-flow generating device 112 and the filtration system 114 are assembled onto a trailer or are skid-mounted.

The debris collecting system 300 further comprises a boom 120, a first conveying pipe 122 supported by the boom 120, a second conveying pipe 322 connected between the first conveying pipe 122 and the intermediate debris collecting container 310, a third conveying pipe 330 connected between the intermediate debris collecting container 310 and the debris body 110, and other equipments for operating the debris collecting system 300 for sewer cleaning, storm drain cleaning, other types of catch basin cleaning, leaf collection, litter collection, hydroexcavation, industrial vacuum cleaning, and other pneumatic conveying applications. Since much of the equipment necessary for operating the debris collecting system 300 is conventional, the description is limited to components of equipment of the debris collecting system 300 that are relevant to the practice of the invention.

The first conveying pipe 122 includes a distal debris-receiving portion 123 or section having a conveying pipe inlet 124. The first conveying pipe 122 also includes a proximal debris body portion 128 or section. As is seen in FIG. 3, the first conveying pipe 122 can include several connected pipe portions in order to obtain a pipe configuration suitable for various debris collecting applications. The distal debris-receiving portion 123 and the proximal debris body portion 128 may be at ends of the pipe 122, or can be located along an intermediate section of the pipe 122.

The second conveying pipe 322 includes a first end portion 324 or section connected to the debris body portion 128 of the first conveying pipe 122. The second conveying pipe 322 further includes a second end portion 326 or section connected to the intermediate debris collecting container 310. As is seen in FIG. 3, the second conveying pipe 322 can also include several connected pipe portions in order to obtain a pipe configuration suitable for various debris collecting applications. The first end portion 324 and second end portion 326 do not necessarily need to be at "ends" of the pipe 322, and can be spaced along other sections of the pipe 322.

The third conveying pipe 330 includes a first end 332 or section connected to the intermediate debris collecting container 310. The first end 332 of the third conveying pipe 330 has a pipe inlet 333. The third conveying pipe 330 further includes a second end 334 or section having a pipe outlet 335. The third conveying pipe 330 can also include several connected pipe portions in order to obtain a pipe configuration suitable for various debris collecting applications. In some embodiments, the second end 334 or section of the third conveying pipe 330 is directly connected to the air conveying pipe 150 either inside the debris body 110 or outside the debris body 110. In some embodiments, the second end 334 or section of the third conveying pipe 330 is directly connected to the filtration system 114. In still some embodiments, the second end 334 or section of the third conveying pipe 330 is directly connected to the air-flow generating device 112. The mechanical efficiency of the system is improved when if the third conveying pipe 330 is directly connected to the air conveying pipe 150, the filtration system 114 or the air-flow generating device 112.

The debris body 110 has in this exemplary debris collecting system 300 a first opening 142 through which the debris body portion 128 of the first conveying pipe 122 is inserted. The debris body 110 further has a second opening 344 through which the first end portion 324 of the second conveying pipe 322 is inserted such that the first end portion 324 of the second conveying pipe 322 connects to the debris body portion 128 of the first conveying pipe 122 inside the debris body 110. The debris body 110 further has a third opening 346 through which the second end 334 of the third conveying pipe 330 is inserted. The debris body 110 further comprises an air and water tight door 146 allowing for cleaning the debris body 110, and for inspecting the debris body 110.

The intermediate debris collecting container 310 includes an inlet 312 connected to the second end 326 of the second conveying pipe 322. The intermediate debris collecting container 310 further includes an outlet 314 connected to the first end 332 of the third conveying pipe 330. The intermediate debris collecting container 310 is placed in close proximity to the truck 100. In some embodiments, the intermediate debris collecting container 310 is placed behind the truck 100 and aligned with the truck 100. This placement is advantageous since only one lane is required for the whole debris collecting system 300 when sewers are accessed from the street. In some embodiments, more than one intermediate debris collecting container 310 is used, which allows for removal of debris for high volume applications wherein the intermediate debris collecting containers are changed out for disposal while the debris collecting truck remains on site. The intermediate debris collecting container 310 may be a roll-off tank or may be a truck mounted tank.

Debris 130 that needs to be removed enters the first conveying pipe 122 with conveying air through the conveying pipe inlet 124. The airborne debris 130 travels through the first conveying pipe 122 and the second conveying pipe 322 through the debris body 110 and exits in the intermediate debris collecting container 310. The debris 130 separates from the conveying air inside the intermediate debris collecting container 310 and falls to a bottom 316 of the container 310.

In some embodiments, the conveying air, separated from most of the debris, enters the pipe inlet 333 of the third conveying pipe 330, travels through the third conveying pipe 330, and exits the third conveying pipe 330 inside the debris body 110 through the pipe outlet 335. The conveying air then enters an air conveying pipe 150 inside the debris body 110 and travels to the filtration system 114, in which possible remaining debris is filtrated from the air. In this embodiment, an additional step in the filtration chain is allowed. The air velocity is reduced upon entering the debris body 110, which causes materials/debris to separate from the conveying air.

In some other embodiments, when the second end 334 or section of the third conveying pipe 330 is directly connected to the air conveying pipe 150 either inside the debris body 110 or outside the debris body 110, the conveying air, separated from most of the debris, enters the pipe inlet 333 of the third conveying pipe 330, travels through the third conveying pipe 330 into the air conveying pipe 150 and travels to the filtration system 114, in which possible remaining debris is filtrated from the air.

In some embodiments, when the second end 334 or section of the third conveying pipe 330 is directly connected to the filtration system 114, the conveying air, separated from most of the debris, enters the pipe inlet 333 of the third conveying pipe 330 and travels to the filtration system 114, in which possible remaining debris is filtrated from the air. In still some other embodiments, when the second end 334 or section of the third conveying pipe 330 is directly connected to the air-flow generating device 112, the conveying air, separated from most of the debris, enters the pipe inlet 333 of the third conveying pipe 330 and travels to the air-flow generating device 112 and further out to the ambient atmosphere. In still further embodiments, there is no filtration or the filtration system is arranged in the intermediate debris collecting container 310.

Figure 4:
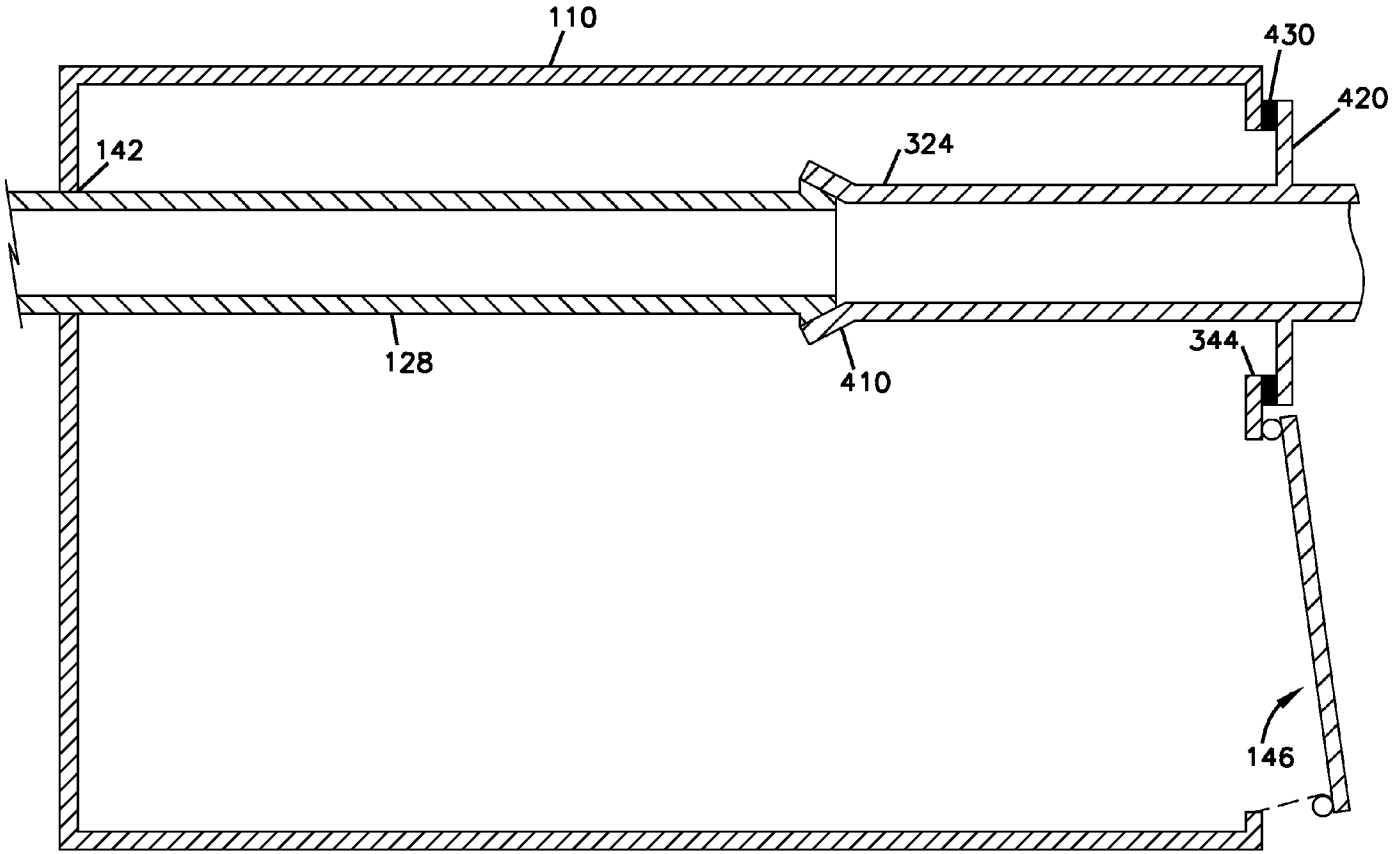
FIG. 4 is a side view in cross-section of an exemplary simplified debris body.

FIG. 4 shows a cross-section of an exemplary debris body 110. The debris body 110 has a first opening 142 through which the debris body portion 128 of the first conveying pipe 122 is inserted. The debris body 110 further has a second opening 344 through which the first end portion 324 of the second conveying pipe 322 is inserted. The first end portion 324 of the second conveying pipe 322 connects to the debris body portion 128 of the first conveying pipe 122 at 410. In some embodiments, the connection 410 is a compression seal. The first end portion 324 includes in some embodiments a flange 420. The flange 420 covers the second opening 344 of the debris body 110 and is sealed with a seal 430 thereto in order to form an air and water tight sealing. In some embodiments the first end portion 324 of the second conveying pipe 322 is an adapter. The adapter is inserted from the rear of the truck 100 through the second opening 344 of the debris body 110, connected to the debris body portion 128 of the first conveying pipe 122, and sealed against the second opening 344 with the flange 420 and the seal 430. The second conveying pipe 322 connects to the adapter 324 outside the debris body 110 in the rear of the truck 100. The debris body 110 can be provided with a cover to seal the second opening 344 and/or the adapter 324 when not in use. As discussed above, the debris body 110 can further include a third opening 346 and an air conveying pipe 150. These are not shown in FIG. 4 for the reason of simplification. Illustrated in FIG. 4 is also an opening in the rear of the debris body 110, which is covered by the air and water tight door 146 allowing for cleaning the debris body 110, and for inspecting the debris body 110. With the second conveying pipe 322 being connected to the rear of the debris body 110, it is not necessary to climb on top of the debris body 110 when connecting the first and second conveying pipes.

Figure 5:
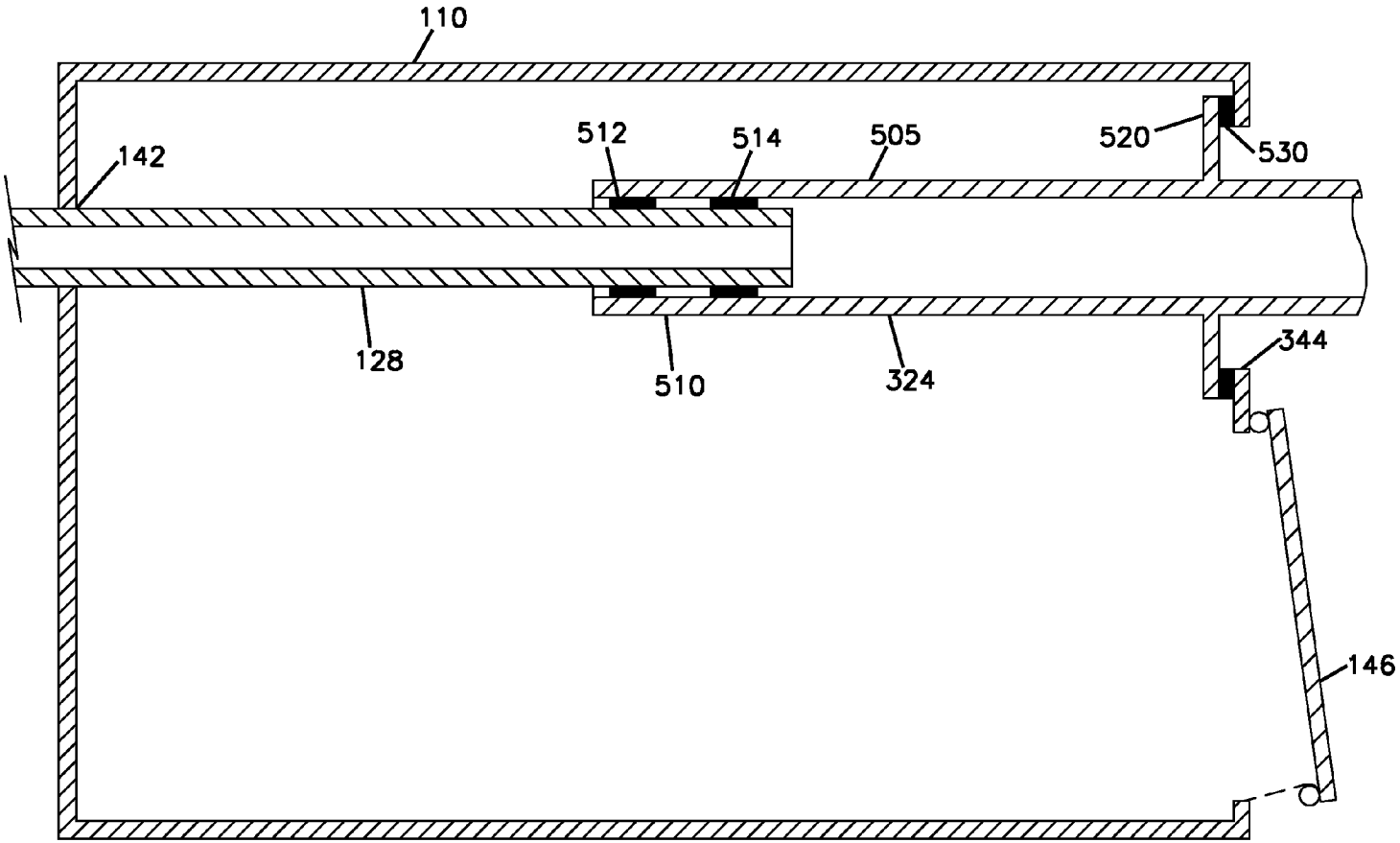
FIG. 5 is a side view in cross-section of another exemplary simplified debris body.

FIG. 5 shows a cross-section of another exemplary debris body 110. The debris body 110 has a first opening 142 through which the debris body portion 128 of the first conveying pipe 122 is inserted. The debris body 110 further has a second opening 344 through which the first end portion 324 of the second conveying pipe 322 is inserted. The first end portion 324 of the second conveying pipe 322 connects to the debris body portion 128 of the first conveying pipe 122 at 510 and is sealed with sealings 512 and 514. In some embodiments the first end portion 324 of the second conveying pipe 322 is an adapter 505. The adapter 505 is slidable coaxially attached to the debris body 128 of the first conveying pipe 122. The adapter 505 has a flange 520 sealing the second opening 344 of the debris body 110 from the inside using a seal 530. The seal 530 forms an air and water tight sealing. The second conveying pipe 322 connects to the adapter 505 outside the debris body 110 in the rear of the truck 100. The movable adapter 505 makes it possible to store the adapter 505 inside the debris body 110 when no intermediate debris collecting container 310 is used and the debris body 110 is used for collecting debris 130. The adapter 505 is moved toward the rear end when used to connect to the second conveying pipe 322. The debris body 110 can be provided with a cover to seal the second opening 344 when the adapter 505 is stored inside the debris body 110. As discussed above, the debris body 110 can further include a third opening 346 and an air conveying pipe 150. These are not shown in FIG. 5 for the reason of simplification. Illustrated in FIG. 5 is also an opening in the rear of the debris body 110, which is covered by the air and water tight door 146 allowing for cleaning the debris body 110, and for inspecting the debris body 110. With the second conveying pipe 322 being connected to the rear of the debris body 110, it is not necessary to climb on top of the debris body 110 when connecting the first and second conveying pipes.

Figure 6:
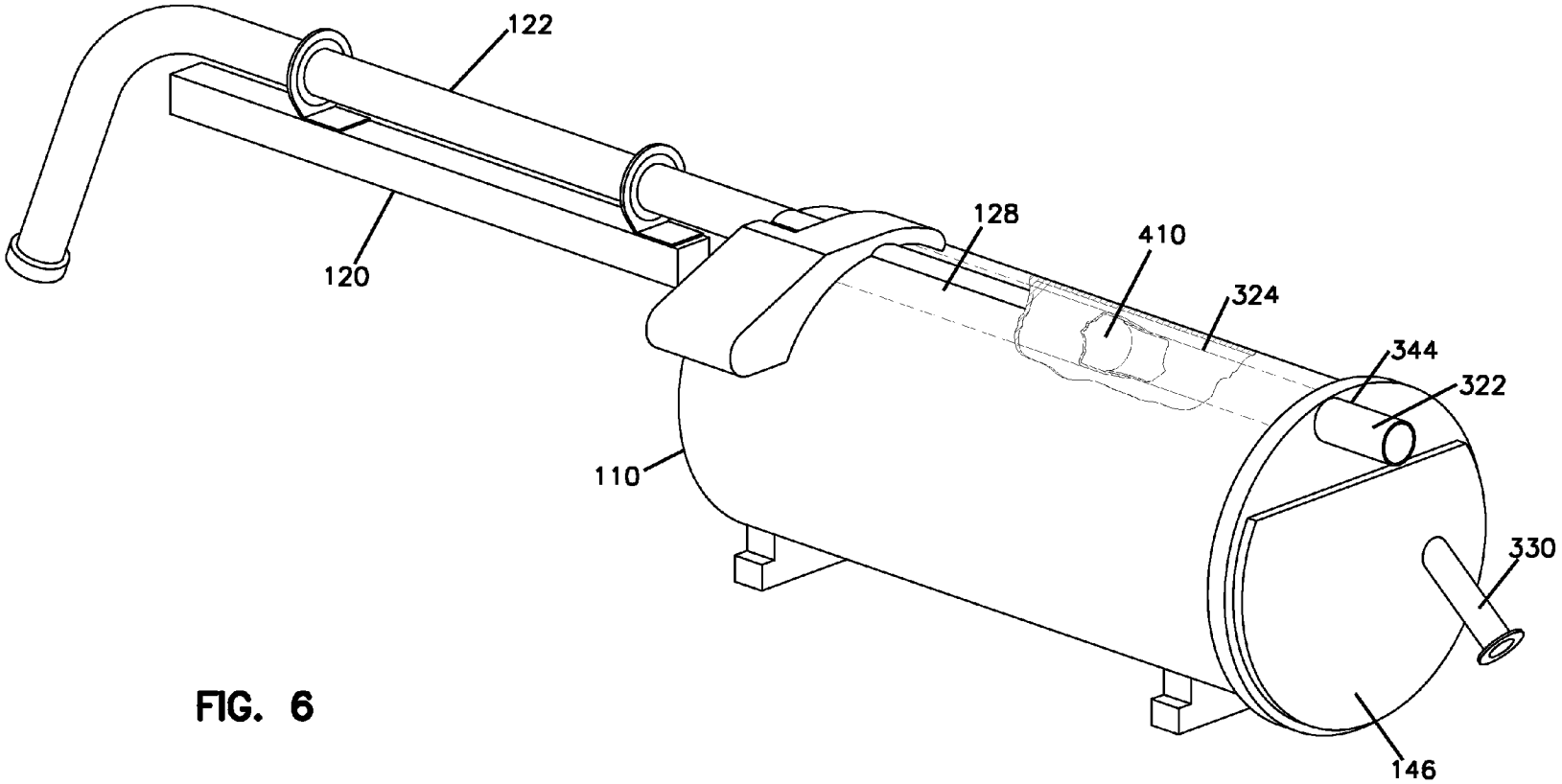
FIG. 6 is an isometric view of an exemplary debris body viewed from the rear.

FIG. 6 shows an exemplary debris body 110 in perspective view from the rear. The debris body portion 128 of the first conveying pipe 122 connects to the first end portion 324 of the second conveying pipe 322 in connection 410 inside the debris body 110. As can be seen in FIG. 6, the second conveying pipe 322 is inserted through and opening 344 in the rear of the debris body 110. Also seen in FIG. 6 is the third conveying pipe 330 and the air and water tight door 146, which may be hydraulically operated.

Figure 7:
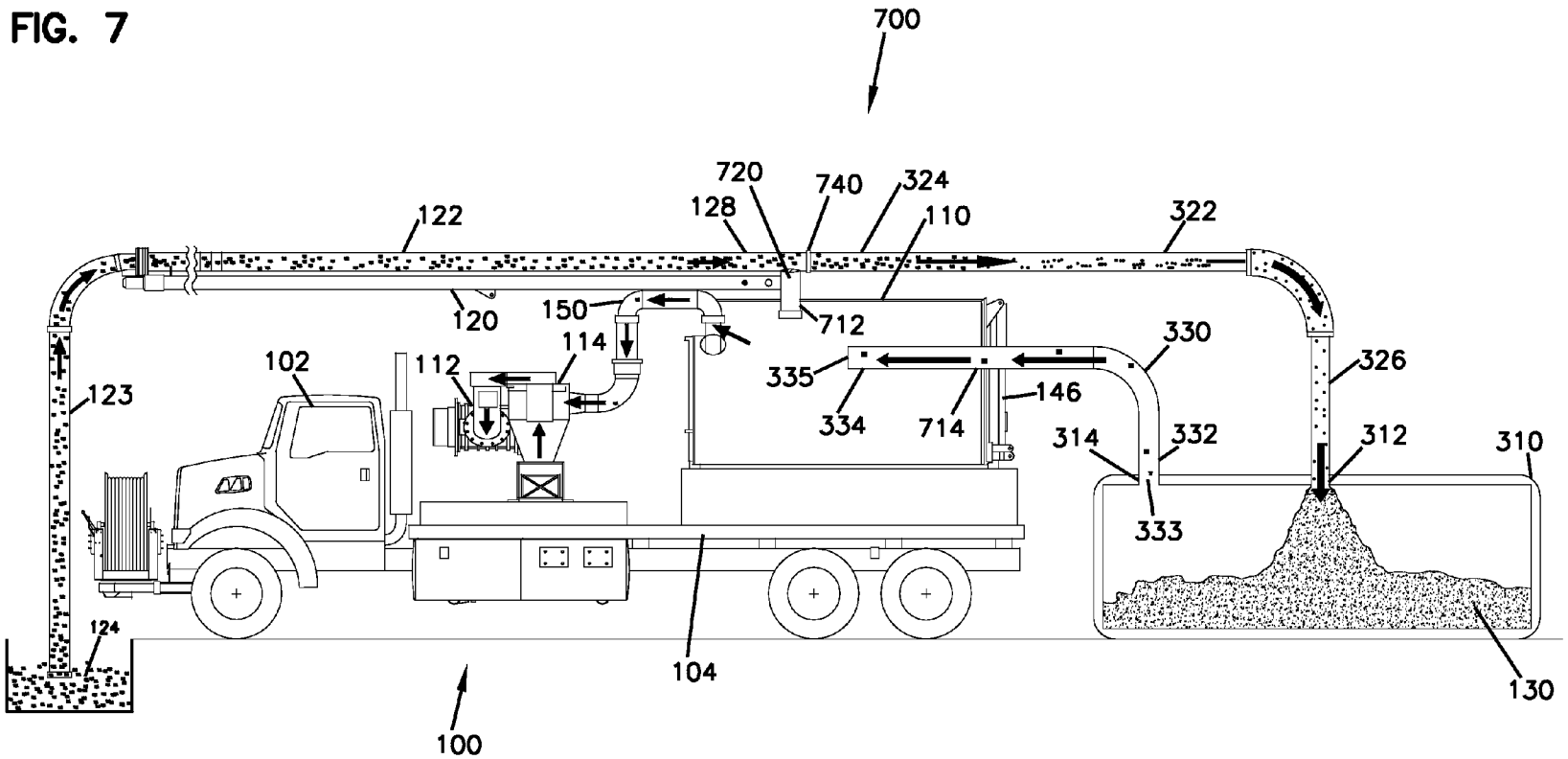
FIG. 7 is a schematic side elevation of another exemplary debris collecting system.

FIG. 7 shows an exemplary debris collecting system 700 comprising a debris collecting truck 100 and an intermediate debris collecting container 310. The debris collecting truck 100 comprises a cab 102 and a truck chassis 104 supporting, for example, a debris body 110, an air-flow generating device 112 and a filtration system 114. In some embodiments the air-flow generating device 112 is a vacuum source. In the shown embodiment, a debris collecting truck 100 is used. However, in some embodiments, the debris body 110, the air-flow generating device 112 and the filtration system 114 are assembled onto a trailer or are skid-mounted.

The debris collecting system 700 further comprises a boom 120, a first conveying pipe 122 supported by the boom 120, a second conveying pipe 322 connected between the first conveying pipe 122 and the intermediate debris collecting container 310, a third conveying pipe 330 connected between the intermediate debris collecting container 310 and the debris body 110, and other equipments for operating the debris collecting system 700 for sewer cleaning, storm drain cleaning, other types of catch basin cleaning, leaf collection, litter collection, hydroexcavation, industrial vacuum cleaning, and other pneumatic conveying applications. Since much of the equipment necessary for operating the debris collecting system 700 is conventional, the description is limited to components of equipment of the debris collecting system 700 that are relevant to the practice of the invention.

The first conveying pipe 122 includes a debris-receiving portion 123 having a conveying pipe inlet 124. The first conveying pipe 122 also includes a debris body portion 128 and a debris body connection pipe 720. The first conveying pipe 122 further includes a shut-off valve (not shown in FIG. 7) arranged between the debris body 128 and the debris body connection pipe 720. The shut-off valve blocks the airborne debris from entering the debris body 110 when an intermediate debris collecting container 310 is used. As is seen in FIG. 7, the first conveying pipe 122 can include several connected pipe portions in order to obtain a pipe configuration suitable for various debris collecting applications.

The boom 120 is mounted on top of the debris body 110. In some embodiments the boom 120 is a hydraulically-operated telescopic power boom configured to support the first conveying pipe 122. In the embodiment shown in FIG. 7, the boom 120 is configured for debris collection in front of the debris collecting truck 100. However, in some embodiments, the boom 120 is configured for debris collection behind the debris collecting truck 100. When the debris collecting system operates at the rear of the debris collecting truck 100, the intermediate debris collecting container 310 is placed in front of and aligned with the debris collecting truck 100.

The second conveying pipe 322 includes a first end portion 324 connected to the debris body portion 128 of the first conveying pipe 122 at connection 740 outside the debris body 110. The second conveying pipe 322 further includes a second end portion 326 connected to the intermediate debris collecting container 310. As is seen in FIG. 7, the second conveying pipe 322 can also include several connected pipe portions in order to obtain a pipe configuration suitable for various debris collecting applications.

The third conveying pipe 330 includes a first end 332 connected to the intermediate debris collecting container 310. The first end 332 of the third conveying pipe 330 has a pipe inlet 333. The third conveying pipe 330 further includes a second end 334 having a pipe outlet 335. The third conveying pipe 330 can also include several connected pipe portions in order to obtain a pipe configuration suitable for various debris collecting applications. In some embodiments, the second end 334 or section of the third conveying pipe 330 is directly connected to the air conveying pipe 150 either inside the debris body 110 or outside the debris body 110. In some embodiments, the second end 334 or section of the third conveying pipe 330 is directly connected to the filtration system 114. In still some embodiments, the second end 334 or section of the third conveying pipe 330 is directly connected to the air-flow generating device 112. The mechanical efficiency of the system is improved when if the third conveying pipe 330 is directly connected to the air conveying pipe 150, the filtration system 114 or the air-flow generating device 112.

The debris body 110 has in this exemplary debris collecting system 700 a top opening 712 through which the debris body connection pipe 720 is inserted. The debris body 110 further has a rear side opening 714 through which the second end 334 of the third conveying pipe 330 is inserted. The debris body 110 further comprises an air and water tight door 146 allowing for cleaning the debris body 110, and for inspecting the debris body 110.

The intermediate debris collecting container 310 includes an inlet 312 connected to the second end 326 of the second conveying pipe 322. The intermediate debris collecting container 310 further includes an outlet 314 connected to the first end 332 of the third conveying pipe 330. The intermediate debris collecting container 310 is placed in close proximity to the truck 100. In some embodiments, the intermediate debris collecting container 310 is placed behind the truck 100 and aligned with the truck 100. This placement is advantageous since only one lane is required for the whole debris collecting system 700 when sewers are accessed from the street. In some embodiments, more than one intermediate debris collecting container 310 is used, which allows for removal of debris for high volume applications wherein the intermediate debris collecting containers are changed out for disposal while the debris collecting truck remains on site. The intermediate debris collecting container 310 may be a roll-off tank or may be a truck mounted tank.

Debris 130 that needs to be removed enters the first conveying pipe 122 with conveying air through the conveying pipe inlet 124. The airborne debris 130 travels through the first conveying pipe 122 and the second conveying pipe 322 over the debris body 110 and exits in the intermediate debris collecting container 310. The debris 130 separates from the conveying air inside the intermediate debris collecting container 310 and falls to a bottom of the container 310.

In some other embodiments, when the second end 334 or section of the third conveying pipe 330 is directly connected to the air conveying pipe 150 either inside the debris body 110 or outside the debris body 110, the conveying air, separated from most of the debris, enters the pipe inlet 333 of the third conveying pipe 330, travels through the third conveying pipe 330 into the air conveying pipe 150 and travels to the filtration system 114, in which possible remaining debris is filtrated from the air.

In some embodiments, when the second end 334 or section of the third conveying pipe 330 is directly connected to the filtration system 114, the conveying air, separated from most of the debris, enters the pipe inlet 333 of the third conveying pipe 330 and travels to the filtration system 114, in which possible remaining debris is filtrated from the air. In still some other embodiments, when the second end 334 or section of the third conveying pipe 330 is directly connected to the air-flow generating device 112, the conveying air, separated from most of the debris, enters the pipe inlet 333 of the third conveying pipe 330 and travels to the air-flow generating device 112 and further out to the ambient atmosphere. In still further embodiments, there is no filtration or the filtration system is arranged in the intermediate debris collecting container 310.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A debris collecting system comprising:

an assembly including an air-flow generating device configured to apply debris conveying air to the system and a debris body configured to collect debris;

a debris collecting container placed in close proximity to the assembly;

a first conveying pipe having a debris-receiving portion and a debris body portion, the debris-receiving portion being configured to receive debris to be removed and the debris body portion being connected to the debris body;

a second conveying pipe having a first end portion connected to the debris body portion of the first conveying pipe and a second end portion connected to the debris collecting container, wherein airborne debris is caused to travel through the first and second conveying pipes and is separated from the conveying air and collected in the debris collecting container; and a third conveying pipe arranged with a first end portion in the debris collecting container and a second end portion connected to a filtration system configured to receive the conveying air and filtrate remaining debris from the conveying air.

2. The debris collecting system of claim 1, wherein the debris body comprises a first opening through which the debris body portion of the first conveying pipe is introduced and a second opening through which the first end portion of the second conveying pipe is introduced such that the first end portion of the second conveying pipe is connected to the debris body portion of the first conveying pipe inside the debris body.

3. The debris collecting system of claim 2, wherein the first end portion of the second conveying pipe is connected to the debris body portion of the first conveying pipe with a compression seal.

4. The debris collecting system of claim 1, further comprising a conveying pipe adapter connecting the first end portion of the second conveying pipe to the debris body portion of the first conveying pipe.

5. The debris collecting system of claim 4, wherein the adapter is coaxially slidable attached on the debris body portion of the first conveying pipe.

6. The debris collecting system of claim 1, wherein the debris body portion of the first conveying pipe is connected to a top of the debris body such that the first end portion of the second conveying pipe is connected to the debris body portion of the first conveying pipe outside the debris body.

7. The debris collecting system of claim 1, wherein the system is configured to collect debris in front of the assembly.

8. The debris collecting system of claim 1, wherein the system is configured to collect debris behind the assembly.

9. The debris collecting system of claim 1, wherein the air-flow generating device is a vacuum source.

* * * * *